US010800174B2

(12) United States Patent
Liu et al.

(10) Patent No.: US 10,800,174 B2
(45) Date of Patent: Oct. 13, 2020

(54) EVAPORATIVE INK-BLOCKING FILM DEVICES STABILIZING INK IN NOZZLES OF INKJET PRINTHEADS

(71) Applicant: Xerox Corporation, Norwalk, CT (US)

(72) Inventors: Chu-heng Liu, Penfield, NY (US); Paul J. McConville, Webster, NY (US); Douglas K. Herrmann, Webster, NY (US); Jason M. LeFevre, Penfield, NY (US); Seemit Praharaj, Webster, NY (US); Michael J. Levy, Webster, NY (US); David A. VanKouwenberg, Avon, NY (US); Linn C. Hoover, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 16/272,074

(22) Filed: Feb. 11, 2019

(65) Prior Publication Data

US 2020/0254762 A1 Aug. 13, 2020

(51) Int. Cl.

| | |
|---|---|
| ***B41J 2/165*** | (2006.01) |
| ***B41J 2/21*** | (2006.01) |
| *B41J 2/01* | (2006.01) |

(52) U.S. Cl.

CPC ..... *B41J 2/16511* (2013.01); *B41J 2/16505* (2013.01); *B41J 2/16552* (2013.01); *B41J 2/2107* (2013.01); *B41J 2/01* (2013.01); *B41J 2002/16594* (2013.01)

(58) Field of Classification Search

CPC B41J 2/16511; B41J 2/16552; B41J 2/16505; B41J 2/2107; B41J 2/01; B41J 2002/16594

See application file for complete search history.

(56) References Cited

U.S. PATENT DOCUMENTS

| | | | |
|---|---|---|---|
| 4,296,418 | A | 10/1981 | Yamazaki et al. |
| 4,364,065 | A | 12/1982 | Yamamori et al. |
| 4,571,601 | A | 2/1986 | Teshima |
| 4,746,938 | A | 5/1988 | Yamamori et al. |
| 4,947,187 | A | 8/1990 | Iwagami |
| 5,300,958 | A | 4/1994 | Burke et al. |

(Continued)

FOREIGN PATENT DOCUMENTS

| | | | |
|---|---|---|---|
| DE | 102011002727 | A1 | 7/2012 |
| EP | 1 827 839 | B1 | 2/2009 |

(Continued)

OTHER PUBLICATIONS

Kwon et al., "Measurement of Inkjet First-Drop Behavior Using a High-Speed Camera," Review of Scientific Instruments; vol. 87, Issue 3, 2016, AIP Publishing, pp. 1-11.

*Primary Examiner* — Yaovi M Ameh

(74) *Attorney, Agent, or Firm* — Gibb & Riley, LLC

(57) ABSTRACT

A cap is positioned to contact a printhead when the printhead is not ejecting liquid ink. The cap and the printhead create a sealed space adjacent printhead nozzles when contacting each other. An evaporator is connected to the cap and is adapted to control evaporation a water-incompatible or solvent-incompatible liquid into the sealed space to condense an ink-blocking film on the surface of the liquid ink in the nozzles to protect the liquid ink in the nozzles. This prevents the ink in the nozzles from drying and prevents the nozzles from clogging.

15 Claims, 8 Drawing Sheets

(56) References Cited

U.S. PATENT DOCUMENTS

| | | | | |
|---|---|---|---|---|
| 5,394,178 | A | 2/1995 | Grange | |
| 5,412,411 | A | 5/1995 | Anderson | |
| 5,635,965 | A | 6/1997 | Purwins et al. | |
| 5,663,751 | A | 9/1997 | Holbrook | |
| 5,670,997 | A | 9/1997 | Sugimoto et al. | |
| 5,726,692 | A | 3/1998 | Yamaguchi et al. | |
| 5,936,647 | A | 8/1999 | Rhodes et al. | |
| 5,949,448 | A | 9/1999 | Man et al. | |
| 5,980,622 | A | 11/1999 | Byers | |
| 6,106,098 | A | 8/2000 | Nakamura et al. | |
| 6,135,585 | A | 10/2000 | Johnson et al. | |
| 6,508,533 | B2 | 1/2003 | Tsujimoto et al. | |
| 6,578,947 | B1 * | 6/2003 | Suwabe | B41J 2/16508 347/29 |
| 6,726,304 | B2 | 4/2004 | Fassler et al. | |
| 7,156,514 | B2 | 1/2007 | Rosa | |
| 7,753,475 | B2 | 7/2010 | Berry et al. | |
| 7,810,899 | B2 | 10/2010 | Usui et al. | |
| 7,992,986 | B2 | 8/2011 | Snyder et al. | |
| 8,592,503 | B2 | 11/2013 | Bogale et al. | |
| 2001/0026299 | A1 | 10/2001 | Tsujimoto et al. | |
| 2002/0180853 | A1 * | 12/2002 | Ohsawa | B41J 2/06 347/95 |
| 2003/0227505 | A1 | 12/2003 | Tanaka et al. | |
| 2003/0231222 | A1 | 12/2003 | Jefferson et al. | |
| 2004/0183879 | A1 | 9/2004 | Nakazawa | |
| 2006/0119645 | A1 | 6/2006 | Berry et al. | |
| 2006/0164460 | A1 | 7/2006 | Uwagaki et al. | |
| 2006/0274110 | A1 * | 12/2006 | Kang | B41J 2/16585 347/33 |
| 2007/0046721 | A1 | 3/2007 | Miyazawa | |
| 2007/0076045 | A1 | 4/2007 | James et al. | |
| 2007/0085875 | A1 | 4/2007 | Shimazaki et al. | |
| 2007/0252863 | A1 | 11/2007 | Sun et al. | |
| 2007/0263026 | A1 | 11/2007 | Shang et al. | |
| 2008/0018677 | A1 | 1/2008 | White et al. | |
| 2008/0024532 | A1 | 1/2008 | Kim | |
| 2008/0204501 | A1 | 8/2008 | Kurita et al. | |
| 2009/0174748 | A1 | 7/2009 | Balcan et al. | |
| 2009/0237424 | A1 | 9/2009 | Martin et al. | |
| 2010/0073445 | A1 | 3/2010 | Silverbrook et al. | |
| 2011/0080443 | A1 | 4/2011 | Teramae | |
| 2012/0162311 | A1 * | 6/2012 | Taira | B41J 2/16508 347/30 |
| 2013/0215189 | A1 | 8/2013 | Justice et al. | |
| 2014/0253633 | A1 | 9/2014 | Kobayashi et al. | |
| 2017/0072720 | A1 | 3/2017 | Yamagishi | |
| 2017/0203573 | A1 | 7/2017 | Hiramoto | |
| 2018/0079217 | A1 | 3/2018 | Hiratsuka et al. | |
| 2018/0244048 | A1 * | 8/2018 | Ito | B41J 11/0085 |
| 2018/0311986 | A1 | 11/2018 | Moriyama | |

FOREIGN PATENT DOCUMENTS

| | | | |
|---|---|---|---|
| JP | 4937785 | B2 | 5/2012 |
| KR | 10-1397307 | B1 | 5/2014 |
| WO | 2008026417 | A1 | 3/2008 |

* cited by examiner

EVAPORATIVE INK-BLOCKING FILM DEVICES STABILIZING INK IN NOZZLES OF INKJET PRINTHEADS

BACKGROUND

Systems and methods herein generally relate to ink jet printers and more particularly to evaporative ink-blocking film devices that stabilize ink in nozzles of inkjet printheads.

Inkjet printers eject drops of liquid marking material (e.g., ink) from nozzles or "jets" of printheads in patterns to perform printing. These nozzles of the inkjet printheads routinely clog when such are unused for extended periods, for example when an inkjet printer does not print for an extended period, or when certain colors or nozzles go unused for an extended period.

This can result in nozzles that do not eject any ink, or that only eject a significantly reduced drop mass, which causes less than optimal pixel placement ("streaky" solid-fill images) and lower than target drop mass (lighter than target solid-densities). If the condition goes uncorrected, it can lead to intermittent firing and the jet can eventually cease firing, and such a situation can be un-recoverable resulting in irreversible print head damage. Depending on the pre-condition of the head, the time scale for onset of such un-recoverable failure could range from a few hours to an overnight/weekend idle time.

Additionally, certain colors (e.g., magenta, etc.) are more susceptible to clogging relative to other colors, because certain color inks dry faster than other color inks, which causes the ink to dry in the nozzles of the printhead during extended inactivity. Such nozzle clogging issues can be mitigated, but not avoided, by purge and cleaning cycles.

SUMMARY

In order to address such issues, exemplary apparatuses herein include, among other components, a printhead that includes nozzles that are adapted to eject liquid ink, and a cap positioned to contact the printhead when the printhead is not ejecting the liquid ink. The cap and the printhead create a sealed space adjacent the nozzles when contacting each other.

Additionally, an evaporator is connected to the cap and is adapted to control evaporation of a water-incompatible or solvent-incompatible liquid into the sealed space that condenses as an ink-blocking film on the surface of the liquid ink in the nozzles, while avoiding spraying the water-incompatible or solvent-incompatible liquid directly on the nozzles. For example, the evaporator can be a dispenser that provides droplets of the water-incompatible or solvent-incompatible liquid into the sealed space, a container or foam pad containing the water-incompatible or solvent-incompatible liquid from which the water-incompatible or solvent-incompatible liquid evaporates, etc.

A vapor control (e.g., valve on the dispenser, lid on the container, cap on the foam pad, etc.) can be connected to, or a component of, the evaporator. The vapor control is adapted to prevent the evaporator from evaporating the water-incompatible or solvent-incompatible liquid when the cap is not contacting the printhead. A reservoir can be connected to the evaporator and can be adapted to supply the water-incompatible or solvent-incompatible liquid to the evaporator. In addition, a heater can be connected to, or a component of, the printhead; and such a heater is adapted to heat the printhead while the cap contacts the printhead to a temperature to evaporate the ink-blocking film on the surface of the liquid ink in the nozzles back into the sealed space to allow the water-incompatible or solvent-incompatible liquid to return to the evaporator.

In one example, a controller can be incorporated into, or be operatively connected to, the evaporator. The controller can be adapted to control the evaporator to evaporate different amounts of the water-incompatible or solvent-incompatible liquid to different color printheads; evaporate the water-incompatible or solvent-incompatible liquid to the sealed space to form the ink-blocking film on the surface of the liquid ink in the nozzles in delayed processing and only after an idle time period (during which the nozzles do not eject the liquid ink) has expired; etc.

Various methods herein position the printhead and the cap to contact one another to create the sealed space between the cap and nozzles of the printhead. Again, the nozzles are adapted to maintain liquid ink. As noted previously, such methods evaporate a water-incompatible or solvent-incompatible liquid into the sealed space to condense an ink-blocking film on the surface of the liquid ink in the nozzles. While many different processes can be used to perform the evaporation, some methods herein can open the vapor control of the evaporator within the cap.

Further, these methods can evaporate different amounts of the water-incompatible or solvent-incompatible liquid to different color printheads. Also, the water-incompatible or solvent-incompatible liquid can be evaporated into the sealed space in delayed processing and only after an idle time period (during which the nozzles do not eject the liquid ink) has expired. Additionally, these methods can heat the printhead (while the cap still contacts the printhead) to a temperature to evaporate the ink-blocking film off the surface of the liquid ink in the nozzles into the sealed space.

These and other features are described in, or are apparent from, the following detailed description.

BRIEF DESCRIPTION OF THE DRAWINGS

Various exemplary systems and methods are described in detail below, with reference to the attached drawing figures, in which.

DETAILED DESCRIPTION

Figure 1:
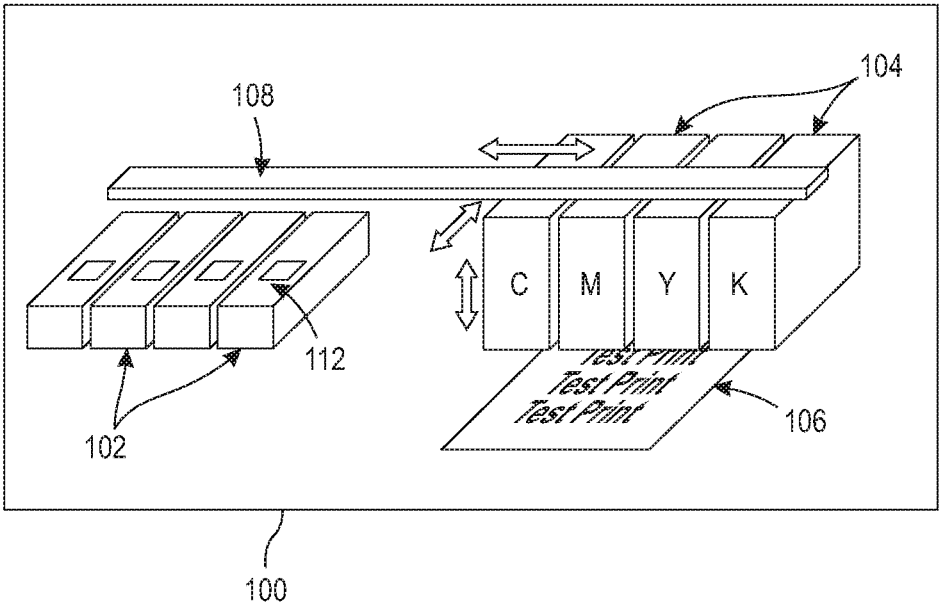
FIGS. 1 and 2 are perspective/exploded conceptual diagrams illustrating inkjet print cartridges and cartridge resting locations of structures herein.

As mentioned above, nozzles of inkjet printheads routinely clog when such are unused for extended periods, and purge and cleaning cycles are not completely effective at preventing clogs. In view of such issues, apparatuses herein use an ink-blocking film to stabilize ink in nozzles of inkjet printheads.

More specifically, structures herein include inkjet printhead resting/parking devices that have a cap that covers the inkjet printhead when not in use, and the cap creates a sealed space around the nozzles. The cap device includes an evaporator that evaporates a water-incompatible or solvent-incompatible liquid into the sealed space that condenses as an ink-blocking film (that blocks the water or solvents in the ink) on the surface of the liquid ink in the nozzles and that seals the nozzles and prevents the ink in the nozzles from drying out. Thus, evaporation of any liquid that is not compatible with water (used in water-based inks) or solvents (used in solvent-based inks) within the sealed space formed by the cap device forms a thin ink-blocking film between the ink in the nozzle and the air, effectively preventing the water or solvents in the ink from evaporating and preventing the ink from drying, and thereby preventing nozzle clogging/blocking.

In greater detail, the ink-blocking film that is formed on the nozzles through condensation has relatively low surface energy, such that it will spread out very thinly on the ink surface. The evaporator in the cap device forms this continuous ink-blocking film between the ink in the nozzles and the air within the sealed space. Due to its low surface energy and incompatibility with water, the condensate ink-blocking film spreads on the liquid ink surface at the very ends of the nozzles to form a continuous ink-blocking film covering the full surface of the ink at the nozzle opening, in a similar way that gasoline/oil forms a thin ink-blocking film over water.

As noted above, the ink-blocking film is incompatible with the water or solvents in the ink. Therefore, the water or solvents in the ink (within the nozzles) does not migrate through the ink-blocking film and does not escape from the nozzles. While the ink-blocking film can be formed of any material that does not mix with water or ink solvents, volatile silicone oils and other similar materials are very useful to form the ink-blocking film.

The evaporative environment is maintained within the sealed space created by the cap device to keep the ink-blocking film layer on the nozzles for as long as is needed, and until the printhead is called upon for media printing operations. For example, the ink-blocking film can be maintained on the nozzles by periodically dispensing drops of the water-incompatible or solvent-incompatible liquid into the bottom of the cap device to allow the water-incompatible or solvent-incompatible liquid to evaporate, by including an exposed liquid reservoir or foam pad containing the water-incompatible or solvent-incompatible liquid within the cap device from which the ink-blocking film evaporates, etc. When the inkjet printhead is not connected to the cap device, the liquid reservoir or foam pad containing the water-incompatible or solvent-incompatible liquid can be covered/sealed to prevent the water-incompatible or solvent-incompatible liquid from evaporating into the exposed atmosphere.

Thus, the methods and structures herein maintain a liquid-vapor dynamic balance within the sealed space between the inkjet printhead and the cap device. Specifically, the water-incompatible or solvent-incompatible liquid will transfer from a reservoir/foam pad (as the evaporated vapor in the sealed space) and condense on the surface of the inkjet printhead. This can be achieved by creating a lower temperature at the printhead than that of the liquid reservoir. Condensation occurs because the vapor pressure at the surface of the water-incompatible or solvent-incompatible liquid is higher than that of the inkjet printhead surface. As the vapor pressure equilibrates, the vapor pressure will exceed the saturation level on the lower temperature printhead surface, causing condensation of the evaporated vapor on the nozzles as an ink-blocking film. As explained above, the condensate ink-blocking film will spread on the ink and faceplate surface to form a continuous ink-blocking film, preventing ink evaporation by sealing the ink surface from the air within the cap.

In addition, simple evaporation can be used to remove the ink-blocking film from the nozzles when resuming printing operations. By separating the inkjet printhead from the cap device the sealed space is opened, and the ink-blocking film spontaneously evaporates quickly from the nozzles when exposed to the air environment outside the cap structure. Thus, prior to resuming printing the methods herein simply the separate the cap and printhead and exercise a printing preparation routine to get the printhead ready for printing. When the cap device is removed from the printhead, the ink-blocking film spontaneously evaporates from the surface of the ink in the nozzles into the exposed surrounding air and leaves no residues on the inkjet faceplate or the ink.

In other alternatives, the printhead can be heated to not only raise the printhead to its standard operating temperature in preparation for printing operations, but to also increase the evaporation rate of the blocking ink-blocking film from all surfaces of the inkjet printhead upon which the ink-blocking film may have condensed. If this heating of the printhead is performed before the printhead is removed from the cap device and the printhead temperature is raised to a level above the temperature of the liquid reservoir, the ink-blocking film can evaporate from the printhead into the atmosphere of the sealed space and condense back into the water-incompatible or solvent-incompatible liquid on the walls of the cap device (and gravity feed to return to the reservoir/foam pad within the cap device). Therefore, these structures/methods prevent ink drying, are non-contact with the printhead, leave no residue, and do not require active control.

Figure 2:
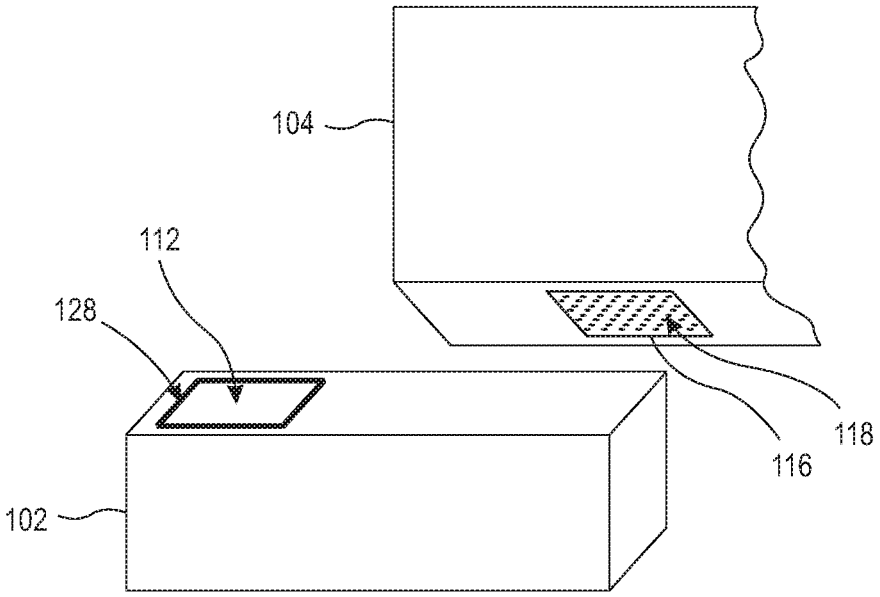

FIGS. 1 and 2 are perspective/exploded conceptual diagrams illustrating some components of an inkjet printing engine 100 that includes inkjet print cartridges 104 and cartridge resting structures 102. One or both of the cartridge resting structures 102 and the inkjet print cartridges 104 are movable along, for example, an actuator/track structure 108. In one example, the inkjet printer cartridges 104 are moved by the actuator/track structure 108 into a printing location to print markings on a sheet of print media 106. When not printing, the inkjet print cartridges 104 move to a "parked," "resting," or "home" position where they connect to a cap 112 of the cartridge resting structures 102. Note, as shown by the block arrows in FIG. 1, the actuator/track structure 108 can move the inkjet print cartridges 104 in many different directions.

The inkjet print cartridges 104 remain connected to the cartridge resting structures 102 unless the inkjet printing engine 100 is in the process of using the inkjet print cartridges 104 for printing. When printing markings on the sheet of print media 106, the ink jet printers 100 eject drops (droplets) of liquid marking material (e.g., ink, etc.) from nozzles 118 (jets) of inkjet printheads 116 in patterns to perform the printing on the print media 106. After printing, the inkjet print cartridges 104 again return to the cartridge resting structures 102.

Again, the nozzles 118 of such inkjet printheads routinely clog when such are unused for extended periods. In order to address such issues, apparatuses herein include the cap 112 as part of the cartridge resting structures 102. The cap 112 is positioned to contact (connect to or join with) the printhead 116 when the printhead 116 is not ejecting the liquid ink. The cap 112 includes a seal 128 so that the cap 112 and the printhead 116 create a sealed space (that is not exposed to the external environment) adjacent the nozzles 118 when contacting or connected to each other (e.g., when the printhead 116 is parked on or resting on the cap 112 in between printing operations).

Figure 3:
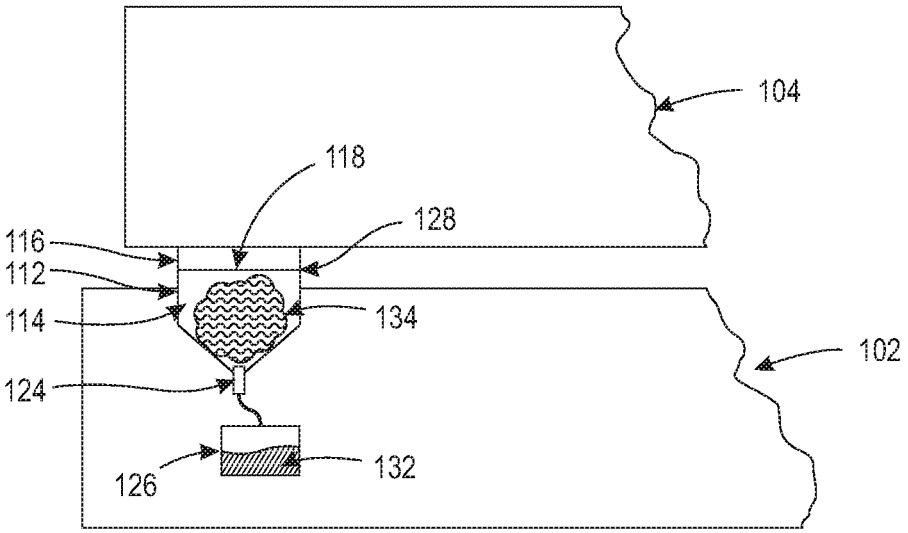
FIG. 3 is a cross-sectional conceptual diagram illustrating an inkjet print cartridge and a cartridge resting location of structures herein.
Figure 4:
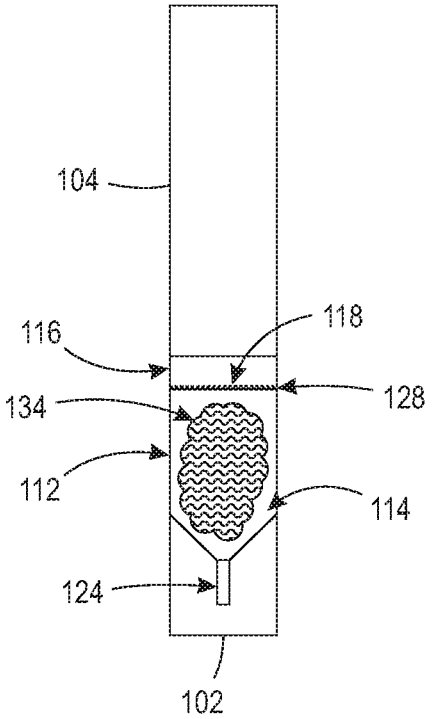
FIG. 4 is an end-view conceptual diagram illustrating an inkjet print cartridge and a cartridge resting location of structures herein.

The sealed space 114 can be more easily seen in the cross-sectional and end views in FIGS. 3 and 4, which show one of the inkjet print cartridges 104 connected to one of the cartridge resting structures 102. As can also be seen in FIGS. 3 and 4, an evaporator 124 is connected to the cap 112 and is adapted to control evaporation a water-incompatible or solvent-incompatible liquid 132 (which may be stored in a reservoir 126) to create a water-incompatible or solvent-incompatible vapor 134 within the sealed space 114. The water-incompatible or solvent-incompatible liquid 132 that is evaporated to form the vapor 134 can be any material (e.g., liquid, gel, etc.) that easily evaporates (e.g., is highly volatile) and is not compatible with water or ink solvents, and that can keep the ink 140 within the nozzles 118 from drying.

Figure 5:
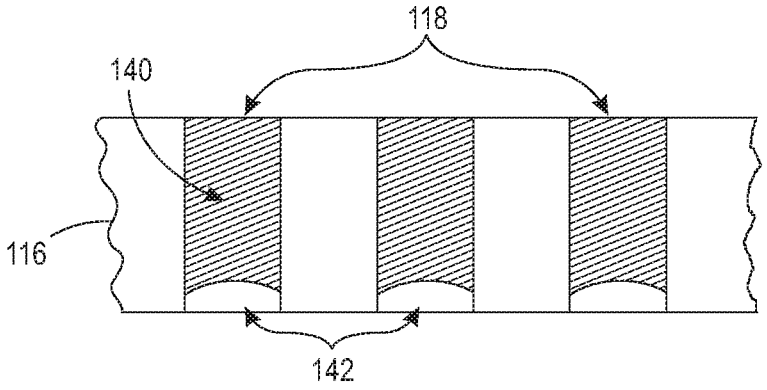
FIGS. 5-6 are cross-sectional conceptual diagrams illustrating a nozzles of inkjet print cartridge of structures herein.
Figure 6:
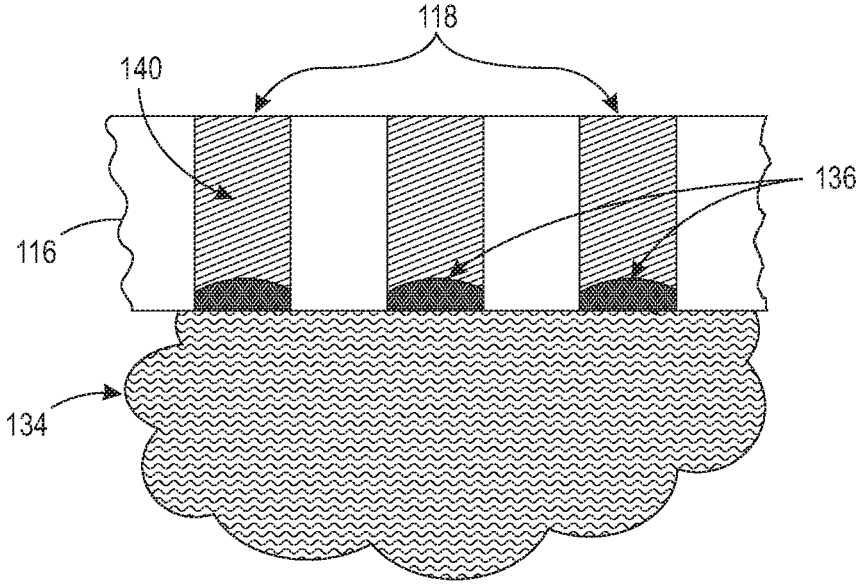

FIGS. 5 and 6 illustrate (in cross-section) a small portion of the inkjet printhead 116 and show liquid ink 140 within a few of the nozzles 118. In FIG. 5, the surface tension/meniscus leaves some space 142 at the open ends (e.g., the nozzle openings from which droplets of liquid ink are ejected) of the nozzles 118. As shown in FIG. 6, the evaporation of the water-incompatible or solvent-incompatible liquid 132 to create the vapor 134 by the evaporator 124 causes a thin ink-blocking film 136 to form on the surface of the ink 140 in the nozzles 118 (and the ink-blocking film 136 can also form on other components of the printhead 116 that were exposed to the vapor 134).

To promote film formation, the water-incompatible or solvent-incompatible liquid 132 has a relatively low surface energy (LSE). The cohesive forces between liquid molecules are responsible for surface tension because the molecules at the surface do not have other like molecules on all sides and consequently, they cohere more strongly to others on the surface. Surface tension is typically measured in dynes/cm (e.g., the force in dynes required to break a film of length 1 cm) or ergs per square centimeter. In some example at 20° C., water-based ink typically has a surface tension of 25-35 dynes/cm, ethyl alcohol has a low surface tension of 22.3 dynes/cm, and mercury has a high surface tension of 465 dynes/cm. The surface tension of the water-incompatible or solvent-incompatible liquid 132 and the condensed ink-blocking film 136 herein is preferably less than that of inks at 20° C. by a significant amount. Therefore, the ink-blocking film 136 formed of the water-incompatible or solvent-incompatible liquid 132 herein spreads very thinly on the exposed ink 140 surface to block the water or solvents in the ink from evaporating.

Further, the water-incompatible or solvent-incompatible liquid 132 is volatile and therefore evaporates easily to become the ink-blocking film 136. Volatility is the tendency of a substance to vaporize and is directly related to a substance's vapor pressure/boiling point. The vapor pressure of a liquid is higher at higher temperature. Condensation occurs when the vapor pressure is higher than the saturated vapor pressure at the temperature of the surface of an object. For example, if liquid 132 is at a temperature higher than the temperature of the printhead, the vapor generated by the liquid 132 will condense on the surface of the printhead as well as the inks in the nozzle. This temperature difference is important and can be achieved by either cooling the printhead or heating the liquid. Once the liquid and the printhead reaches the same temperature, the evaporation and condensation process will stop. The blocking liquid film 136 will stay and maintain its thickness.

The evaporator 122A-C can be any number of different devices capable of forming the vapor 134 and can include a container 124A (FIGS. 7A-7B), a foam pad 124B (FIGS. 8A-8B), a dispenser 124C (FIGS. 9D-9B), etc. Also, such devices can include a vapor control device (e.g., lid 122A on a container 124A (shown in FIGS. 7A-7B discussed below), cover 122B on a foam pad 124B (shown in FIGS. 8A-8B discussed below), valve 122C on a dispenser 124C (shown in FIGS. 9A-9B discussed below), etc.) and the vapor control device can be connected to, or a component of, the evaporator 124. The vapor control is adapted to prevent the evaporator 124 from evaporating the water-incompatible or solvent-incompatible liquid 132 when the cap device 112 is not contacting the printhead 116.

Figure 7A:
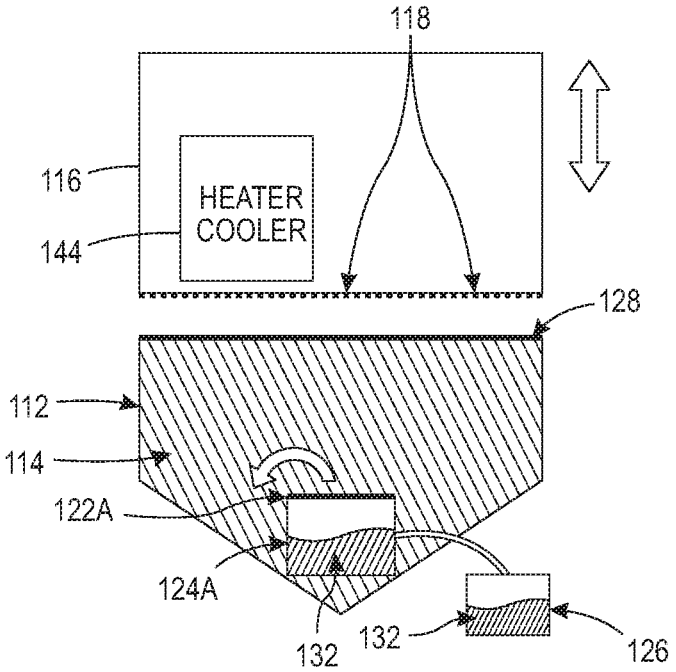
FIGS. 7A-9B are enlarged cross-sectional views of a cap device and printhead of structures herein.
Figure 7B:
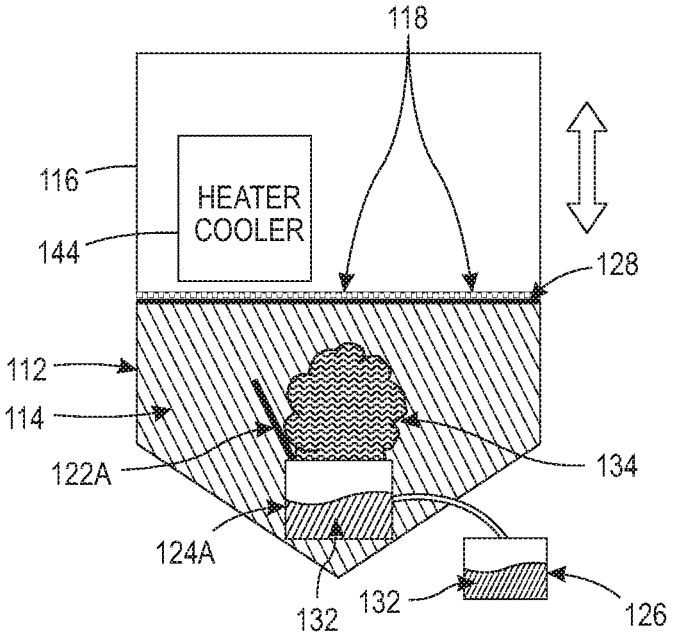

More specifically, FIGS. 7A and 7B are enlarged cross-sectional views of the cap device 112 and show one example where the evaporator 124 is a container 124A positioned within the cap device 112. The container 124A includes a vapor control device that is a lid 122A. FIG. 7A shows the printhead 116 disconnected from the cap device 112, and in this situation the lid 122A is controlled to be closed, preventing the water-incompatible or solvent-incompatible liquid 132 from evaporating. In contrast, FIG. 7B shows the printhead 116 connected to the cap device 112, and in this situation the lid 122A is controlled to be open, allowing the water-incompatible or solvent-incompatible liquid 132 to evaporate from the container 124A into the sealed space 114 and form the vapor 134 (which condenses as the ink-blocking film 136 on the liquid ink 140 in the nozzles 118, as shown in FIG. 6 discussed above). Note again that the reservoir 126 can be connected to the evaporator 124A and can be adapted to supply the water-incompatible or solvent-incompatible liquid 132 to the evaporator 124A.

Additionally, as shown in FIGS. 7A-7B, a printhead heater/cooler 144 can be connected to, or a component of, the printhead 116. The printhead heater/cooler 144 heater is useful for cooling the printhead 116 to promote condensation of the ink-blocking film 136 thereon, or raising the temperature of the printhead 116 above room temperature during printing operations to reduce viscosity of ink to aid in ink flow, aid in ink drying, etc. In structures and methods disclosed herein, the printhead heater/cooler 144 can also be adapted to heat the printhead 116 while the cap 112 still contacts the printhead 116 to a temperature higher than the temperature of the liquid 132, that will evaporate the ink-blocking film 136 from the surface of the liquid ink 140 in the nozzles 118, and from any other components upon which the ink-blocking film 136 has condensed. More specifically, with the cap 112 still contacting the printhead 116, the printhead heater/cooler 144 causes the ink-blocking film 136 to evaporate back into the sealed space 114 as the vapor 134. This allows the vapor 134 to re-condense and return to allow the water-incompatible or solvent-incompatible liquid 132 to return to the evaporator 124. In some examples, when the printhead heater/cooler 144 causes evaporation of the ink-blocking film 136 into vapor 134, the vapor can re-condense within the container 124A or can re-condense along sidewalls of the cap device 112 and drain (by gravity) back into the container 124A, etc. Re-condensing the ink-blocking film 136 and returning the water-incompatible or solvent-incompatible liquid 132 to the evaporator 124 (and potentially to the reservoir 126) helps conserve the amount of the water-incompatible or solvent-incompatible liquid 132 that is consumed.

Figure 8A:
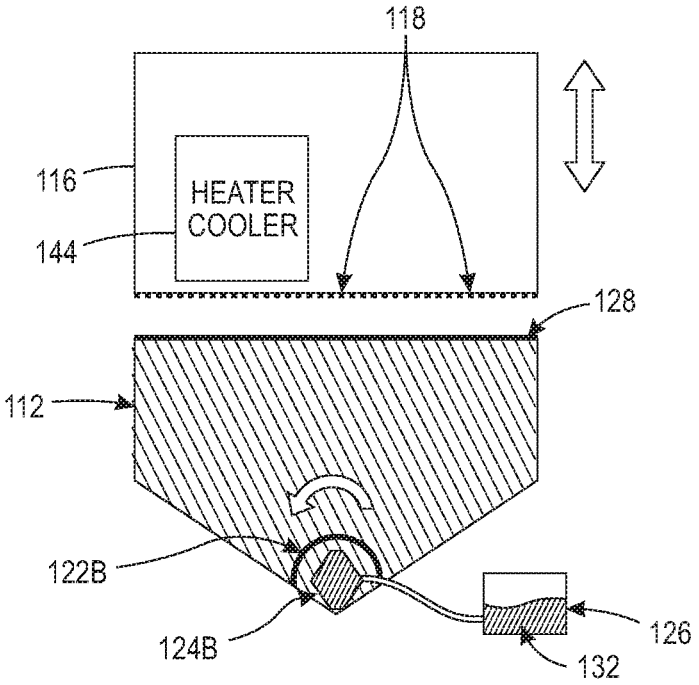
Figure 8B:
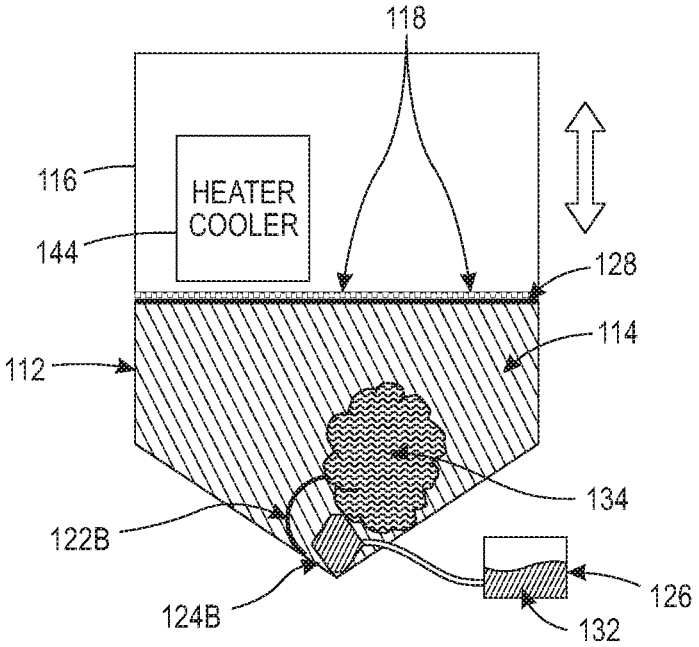

Similar to the structures discussed above, FIGS. 8A and 8B are enlarged cross-sectional views of the cap device 112 and show a different example where the evaporator 124 is a foam pad 124B positioned within the cap device 112. The foam pad 124B includes a vapor control device that is a cover 122B. FIG. 8A shows the printhead 116 disconnected from the cap device 112, and in this situation the cover 122B is controlled to be closed, preventing the water-incompatible or solvent-incompatible liquid 132 from evaporating. In contrast, FIG. 8B shows the printhead 116 connected to the cap device 112, and in this situation the cover 122B is controlled to be open, allowing the water-incompatible or solvent-incompatible liquid 132 to evaporate from the foam pad 124B into the sealed space 114 and form the vapor 134 (which condenses as the ink-blocking film 136 on the liquid ink 140 in the nozzles 118, as shown in FIG. 6 discussed above). Note again that the reservoir 126 can be connected to the evaporator 124B and can be adapted to supply the water-incompatible or solvent-incompatible liquid 132 to the evaporator 124B. The heater/cooler 144 operates as described above to aid in evaporation and re-evaporation.

Figure 9A:
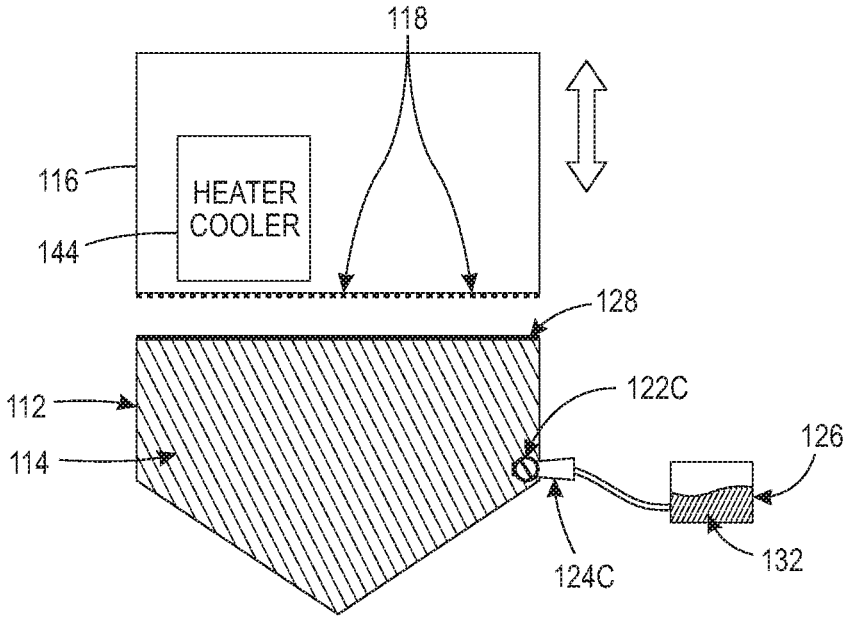
Figure 9B:
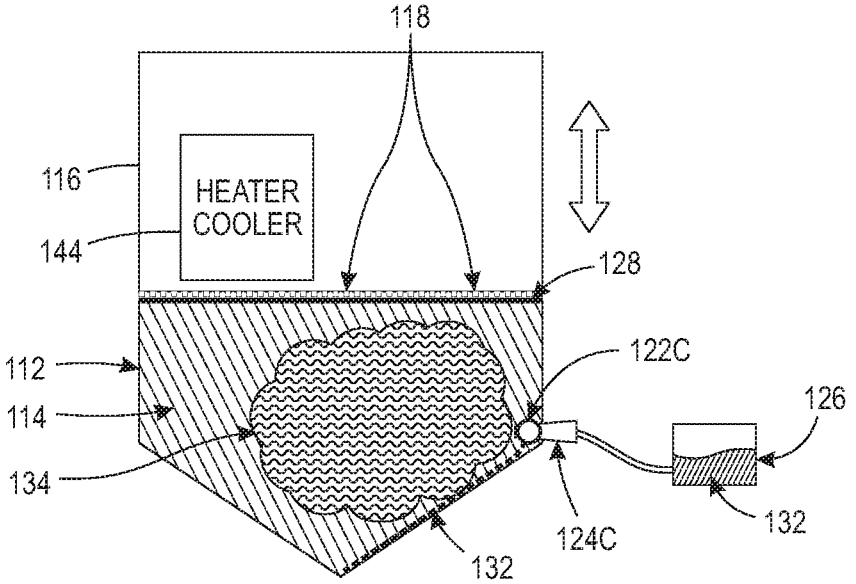

FIGS. 9A and 9B are also enlarged cross-sectional views of the cap device 112 and show yet another example where the evaporator 124 is a dispenser 124C positioned to dispense the water-incompatible or solvent-incompatible liquid 132 within the cap device 112. The dispenser 124C includes a vapor control device that is a valve 122C. FIG. 9A shows the printhead 116 disconnected from the cap device 112, and in this situation the valve 122C is controlled to be closed, preventing the water-incompatible or solvent-incompatible liquid 132 from being dispensed into the cap device 112. In contrast, FIG. 9B shows the printhead 116 connected to the cap device 112, and in this situation the valve 122C is controlled to be open, allowing the water-incompatible or solvent-incompatible liquid 132 to be dispensed into the sealed space 114 (e.g., droplets along the sidewalls and bottom of the cap device 112) from which the water-incompatible or solvent-incompatible liquid 132 evaporates to form the vapor 134 (which condenses as the ink-blocking film 136 on the liquid ink 140 in the nozzles 118, as shown in FIG. 6 discussed above). Note again that the reservoir 126 can be connected to the evaporator 124C and can be adapted to supply the water-incompatible or solvent-incompatible liquid 132 to the evaporator 124C. The heater/cooler 144 operates as described above to aid in evaporation and re-evaporation.

The evaporators 124 herein (and/or the vapor control devices 122A-122C) can be adapted herein to evaporate different amounts of the water-incompatible or solvent-incompatible liquid 132 to different color printheads 116 (e.g., more vapor 134 for magenta printheads, less for cyan printheads, etc.); evaporate the water-incompatible or solvent-incompatible liquid 132 to the sealed space 114 to form the ink-blocking film 136 on the surface of the liquid ink 140 in the nozzles 118 in delayed processing and only after an idle time period (during which the nozzles do not eject the liquid ink) has expired; etc. Therefore, some color printheads may not receive the ink-blocking film 136 as often as other color printheads. Also, while the printhead 116 may be connected to the cap device 112 whenever printing operations are paused, the vapor control devices 122A-122C may be controlled to only allow the evaporator 124 to form the ink-blocking film 136 after a printhead has not been used for an established time period (hours, days, etc.) to again conserve the amount of the water-incompatible or solvent-incompatible liquid 132 that is consumed.

Figure 10:
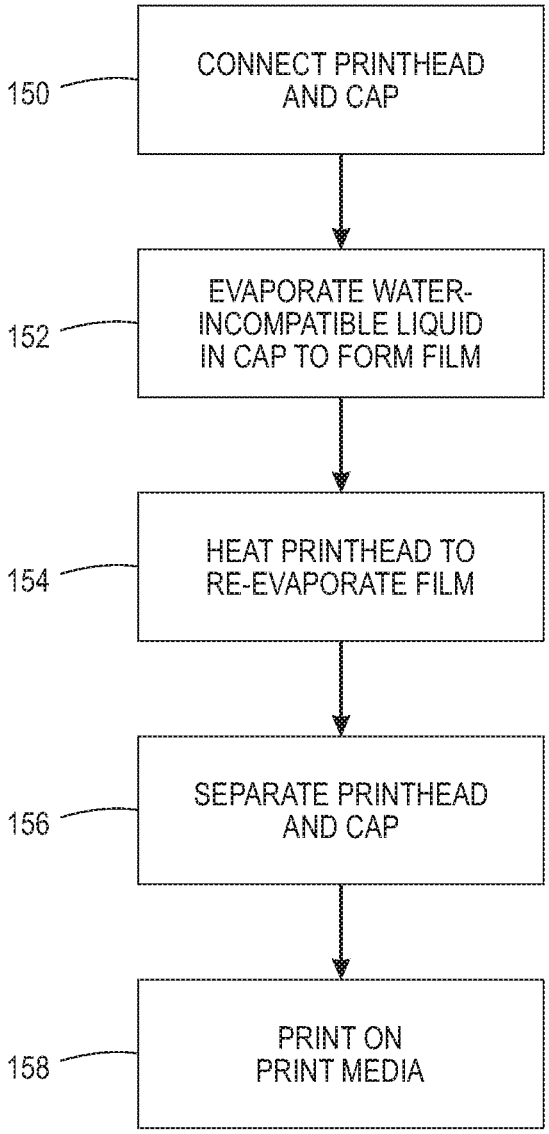
FIG. 10 is a flowchart illustrating methods herein.

FIG. 10 illustrates some aspects of various methods herein, where such methods position the printhead and the cap to contact or connect with one another (in item 150) to create the sealed space between the cap and nozzles of the printhead. As noted previously, in item 152 such methods evaporate the water-incompatible or solvent-incompatible liquid into the sealed space to condense an ink-blocking film on the surface of the liquid ink in the nozzles. While many different processes can be used to perform the evaporation in item 152, some methods herein can open the vapor control of the evaporator within the cap.

Further, in item 152, these methods can evaporate different amounts of the water-incompatible or solvent-incompatible liquid to different color printheads. Further, the water-incompatible or solvent-incompatible liquid can be evaporated into the sealed space only after an idle time period (during which the nozzles do not eject the liquid ink) has expired.

Additionally, as shown in item 154, these methods can heat the printhead (while the cap still contacts the printhead) to a temperature to evaporate the ink-blocking film off the surface of the liquid ink in the nozzles into the sealed space. As noted previously, the re-evaporated film re-condenses back into the evaporator to be reused for later cycles.

Nozzle flushing and other similar pre-printing ink preparation processes are not needed (but can be used) with embodiments herein because the ink-blocking film protects the ink within the nozzles and because the ink-blocking film is highly volatile in ambient air and spontaneously evaporates when the printhead is separated from the cap device. Therefore, with structures and methods herein, the vapor environment within the sealed space between the nozzles and the cap device keeps the ink-blocking film on the liquid ink within the nozzles to protect the liquid ink during extended periods of non-printing; however, simple separation of the printhead from the cap device allows the ink-blocking film to evaporate into the ambient environment, allowing the nozzles to immediately print without need for flushing, etc.

Figure 11:
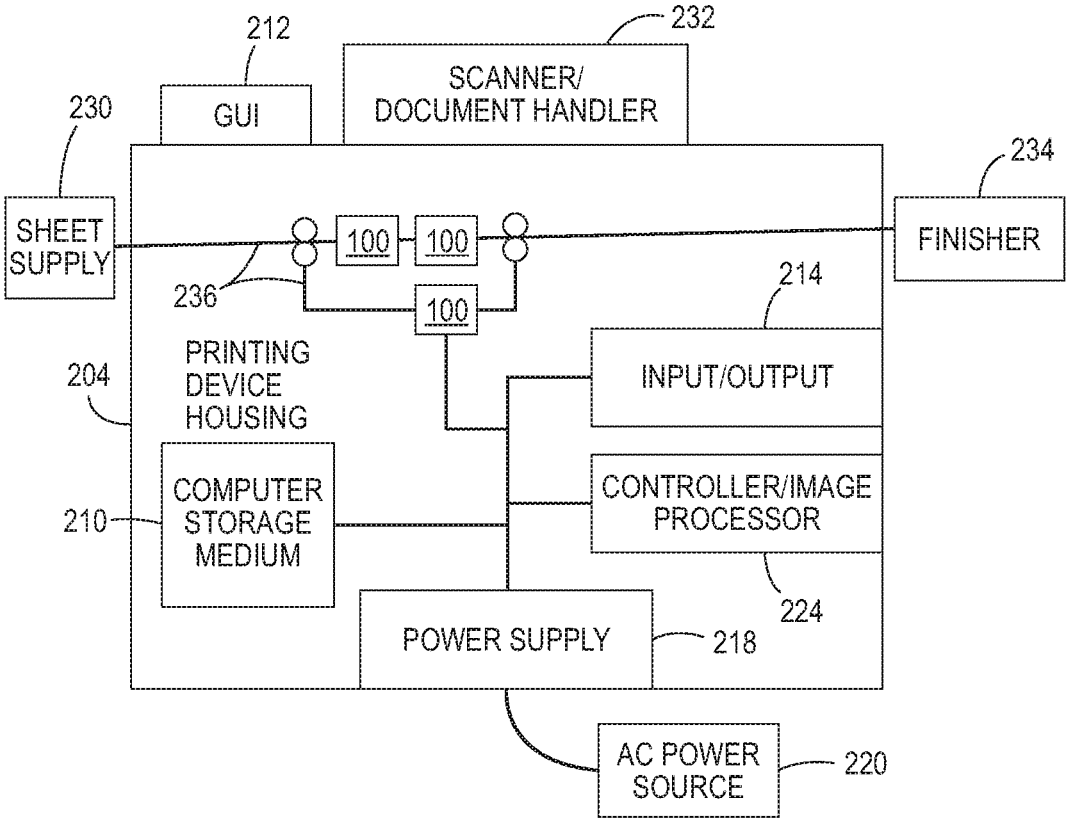
FIG. 11 is a conceptual diagram illustrating printing devices herein.

FIG. 11 illustrates many components of printer structures 204 herein that can comprise, for example, a printer, copier, multi-function machine, multi-function device (MFD), etc. The printing device 204 includes a controller/tangible processor 224 and a communications port (input/output) 214 operatively connected to the tangible processor 224 and to a computerized network external to the printing device 204. Also, the printing device 204 can include at least one accessory functional component, such as a graphical user interface (GUI) assembly 212. The user may receive messages, instructions, and menu options from, and enter instructions through, the graphical user interface or control panel 212.

The input/output device 214 is used for communications to and from the printing device 204 and comprises a wired or wireless device (of any form, whether currently known or developed in the future). The tangible processor 224 controls the various actions of the printing device 204. A non-transitory, tangible, computer storage medium device 210 (which can be optical, magnetic, capacitor based, etc., and is different from a transitory signal) is readable by the tangible processor 224 and stores instructions that the tangible processor 224 executes to allow the computerized device to perform its various functions, such as those described herein. Thus, as shown in FIG. 11, a body housing has one or more functional components that operate on power supplied from an alternating current (AC) source 220 by the power supply 218. The power supply 218 can comprise a common power conversion unit, power storage element (e.g., a battery, etc.), etc.

The printing device 204 includes at least one marking device (printing engine(s)) 100 that use marking material, and are operatively connected to a specialized image processor 224 (that may be different from a general purpose computer because it is specialized for processing image data), a media path 236 positioned to supply continuous media or sheets of media from a sheet supply 230 to the marking device(s) 100, etc. After receiving various markings from the printing engine(s) 100, the sheets of media can optionally pass to a finisher 234 which can fold, staple, sort, etc., the various printed sheets. Also, the printing device 204 can include at least one accessory functional component (such as a scanner/document handler 232 (automatic document feeder (ADF)), etc.) that also operate on the power supplied from the external power source 220 (through the power supply 218).

The one or more printing engines 100 are intended to illustrate any marking device that applies marking material (toner, inks, plastics, organic material, etc.) to continuous media, sheets of media, fixed platforms, etc., in two- or three-dimensional printing processes, whether currently known or developed in the future. The printing engines 100 can include, for example, inkjet printheads, contact printheads, three-dimensional printers, etc.

As noted above, the vapor 134 level in the sealed space 114 can be maintained at different levels for different printheads, different inks, different colors, different print bars, etc. When printheads, inks, colors, etc., are installed in a printer, the controller 224 is made aware of the printer's components. Therefore, the controller 224 can control the evaporator 124 and/or the vapor control devices 122A-122C to: evaporate different amounts of the water-incompatible or solvent-incompatible liquid 132 to the different color printheads 116 within the printer; evaporate specific amounts of the water-incompatible or solvent-incompatible liquid 132 to specific types of printheads 116 used within the printer; evaporate the water-incompatible or solvent-incompatible liquid 132 in the sealed space to condense an ink-blocking film 136 on the surface of the liquid ink in the nozzles 118 only after an idle time period (that can be specific to the ink or printheads within the printer) has expired, etc.

While some exemplary structures are illustrated in the attached drawings, those ordinarily skilled in the art would understand that the drawings are simplified schematic illustrations and that the claims presented below encompass many more features that are not illustrated (or potentially many less) but that are commonly utilized with such devices and systems. Therefore, Applicants do not intend for the claims presented below to be limited by the attached drawings, but instead the attached drawings are merely provided to illustrate a few ways in which the claimed features can be implemented.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known and are not described in detail herein to keep this disclosure focused on the salient features presented. The systems and methods herein can encompass systems and methods that print in color, monochrome, or handle color or monochrome image data.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user. In the drawings herein, the same identification numeral identifies the same or similar item.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the systems and methods herein cannot be implied or imported from any above example as limitations to any particular order, number, position, size, shape, angle, color, or material.

What is claimed is:

1. An apparatus comprising:

a printhead comprising nozzles adapted to eject liquid ink;

a cap positioned to contact the printhead when the printhead is not ejecting the liquid ink, wherein the cap and the printhead create a sealed space adjacent the nozzles when contacting each other;

an evaporator connected to the cap and adapted to control evaporation of a liquid into the sealed space to condense an ink-blocking film on the liquid ink in the nozzles, wherein the liquid comprises a water-incompatible or solvent-incompatible liquid; and a printhead cooler adapted to cool the nozzles to condense the ink-blocking film on the liquid ink in the nozzles.

2. The apparatus according to claim 1, wherein the printhead comprises a heater adapted to heat the printhead while the cap contacts the printhead to a temperature to evaporate the ink-blocking film on the surface of the liquid ink in the nozzles into the sealed space.

3. The apparatus according to claim 1, further comprising a controller connected to the evaporator adapted to control the evaporator to evaporate different amounts of the liquid to different color printheads.

4. The apparatus according to claim 1, further comprising a controller connected to the evaporator adapted to control the evaporator to evaporate the liquid to the sealed space to condense the ink-blocking film on the surface of the liquid ink in the nozzles only after an idle time period, during which the nozzles do not eject the liquid ink, has expired.

5. The apparatus according to claim 1, wherein the evaporator is adapted to avoid spraying the liquid directly on the nozzles.

6. An apparatus comprising:

a printhead comprising nozzles adapted to eject liquid ink;

a cap positioned to contact the printhead when the printhead is not ejecting the liquid ink, wherein the cap and the printhead create a sealed space adjacent the nozzles when contacting each other;

an evaporator connected to the cap and adapted to control evaporation a liquid into the sealed space and condense an ink-blocking film on the liquid ink in the nozzles, wherein the liquid comprises a water-incompatible or solvent-incompatible liquid;

a vapor control connected to the evaporator, wherein the vapor control is adapted to prevent the evaporator from evaporating the liquid when the cap is not contacting the printhead; and a printhead cooler adapted to cool the nozzles to condense the ink-blocking film on the liquid ink in the nozzles.

7. The apparatus according to claim 6, wherein the printhead comprises a heater adapted to heat the printhead while the cap contacts the printhead to a temperature to evaporate the ink-blocking film on the surface of the liquid ink in the nozzles into the sealed space.

8. The apparatus according to claim 6, further comprising a controller connected to the evaporator adapted to control the evaporator to evaporate different amounts of the liquid to different color printheads.

9. The apparatus according to claim 6, further comprising a controller connected to the evaporator adapted to control the evaporator to evaporate the liquid to the sealed space to condense the ink-blocking film on the surface of the liquid ink in the nozzles only after an idle time period, during which the nozzles do not eject the liquid ink, has expired.

10. The apparatus according to claim 6, further comprising a reservoir operatively connected to the evaporator and adapted to supply the liquid to the evaporator.

11. A method comprising:

positioning a printhead and a cap to contact one another to create a sealed space between the cap and nozzles of the printhead, wherein the nozzles are adapted to maintain liquid ink;

evaporating a liquid into the sealed space to condense an ink-blocking film on the liquid ink in the nozzles, wherein the liquid comprises a water-incompatible or solvent-incompatible liquid; and cooling the nozzles to condense the ink-blocking film on the liquid ink in the nozzles.

12. The method according to claim 11, wherein the evaporating comprises opening a vapor control of an evaporator within the cap.

13. The method according to claim 11, further comprising heating the printhead while the cap contacts the printhead to a temperature to evaporate the ink-blocking film on the surface of the liquid ink in the nozzles into the sealed space.

14. The method according to claim 11, further comprising evaporating different amounts of the liquid to different color printheads.

15. The method according to claim 11, wherein the liquid is evaporated into the sealed space only after an idle time period, during which the nozzles do not eject the liquid ink, has expired.

* * * * *